US011639251B2

(12) United States Patent
Ferrari et al.

(10) Patent No.: US 11,639,251 B2
(45) Date of Patent: May 2, 2023

(54) COMPACT CAP AND CAP AND CONTAINER ASSEMBLY WITH AN OPENING BLOCK, AFTER OPENING

(71) Applicant: Affaba & Ferrari S.r.l., Borgo San Giovanni (IT)

(72) Inventors: Silvia Ferrari, Lodi (IT); Guglielmo Ferrari, Lodi (IT)

( * ) Notice: Subject to any disclaimer, the term of this patent is extended or adjusted under 35 U.S.C. 154(b) by 0 days.

(21) Appl. No.: 17/306,789

(22) Filed: May 3, 2021

(65) Prior Publication Data

US 2021/0354883 A1 Nov. 18, 2021

(30) Foreign Application Priority Data

May 12, 2020 (IT) ..... 102020000010690

(51) Int. Cl.
*B65D 41/34* (2006.01)
*B65D 55/16* (2006.01)

(52) U.S. Cl.
CPC ..... *B65D 41/3428* (2013.01); *B65D 55/16* (2013.01)

(58) Field of Classification Search
CPC ..... B65D 41/3428; B65D 55/16; B65D 2401/30; B65D 41/485; B65D 2251/1008
USPC ..... 215/237
See application file for complete search history.

(56) References Cited

U.S. PATENT DOCUMENTS 4,505,401 A * 3/1985 Berglund ..... B65D 41/3452 215/252
5,088,612 A 2/1992 Storar
6,474,491 B1 11/2002 Benoit-Gonin
2002/0096532 A1 7/2002 Berge
2011/0114593 A1* 5/2011 Ishii ..... B65D 55/16 215/253

(Continued)

FOREIGN PATENT DOCUMENTS

DE 202019106993 U1 * 3/2020 ..... B65D 41/3404
ES 1232089 U * 7/2019 ..... B65D 41/08

(Continued)

OTHER PUBLICATIONS

Appendage—Definition by Merriam-Webster Dictionary, retrieved from URL https://www.merriam-webster.com/dictionary/appendage (Year: 2022).*

(Continued)

*Primary Examiner* — Jennifer Robertson
*Assistant Examiner* — Eric C Baldrighi
(74) *Attorney, Agent, or Firm* — Themis Law

(57) ABSTRACT

A compact cap with an opening block, after opening, for a container having a mouthpiece, includes a base ring preventing separation from the mouthpiece, a protective cap or cover for opening and closing the mouthpiece, a hinge arrangement that makes the base ring and the cover integral, and frangible bridges, which connect a lower edge of the cover with an upper edge of the base ring when the cover is closing on the ring base and the mouthpiece. The hinge arrangement includes a plurality of spaced strips or bridges, which connect the cover and the base ring, and an extension enlarged outwardly, which forms an integral part of an annular collar and is obtained at the lower end of the cover, and which becomes engaged with the mouthpiece when the cover is rotated from a closed position to an open position to provide a stable open position of the cover.

10 Claims, 5 Drawing Sheets

(56) References Cited

U.S. PATENT DOCUMENTS

2016/0016706 A1 1/2016 Rognard

FOREIGN PATENT DOCUMENTS

WO 2019110853 6/2019
WO 2019113681 6/2019

OTHER PUBLICATIONS

Italian Search Report of priority application IT 102020000010690, dated Feb. 16, 2021—Relevant portions are in English.

* cited by examiner

COMPACT CAP AND CAP AND CONTAINER ASSEMBLY WITH AN OPENING BLOCK, AFTER OPENING

FIELD OF THE INVENTION

The present invention relates to a compact cap and a cap and container assembly with an opening block, after opening.

BACKGROUND OF THE INVENTION

Caps can generally be provided for closing containers of liquids, which are arranged on the mouthpiece of the container and normally have a tamper-proof ring, to which a protective cover is attached. These caps are snap-arranged on the mouth of the container and create the required seal due to the presence of a complementary projection and recess formed respectively on the mouthpiece of the container and inside a protective cover or cap.

Typically, the cap cover can be rotated upon opening and closing around a hinge arrangement formed between the tamper-proof ring and the cover that prevents the cover from being dispersed in the environment, once removed.

These caps have an extremely small encumbrance and are generally used in containers of milk, water, soft drinks, etc., which at the most have internal pressures of one bar. They are not suitable however for carbonated water at a pressure of two-three bars or other pressurized liquids.

These known caps, when removed upon opening by forcing the snap-engagement and by breaking their frangible bridges, tend to return to the closed or semi-closed position, so hindering the user who would like to drink directly from the mouthpiece. When broken, the frangible bridges naturally reveal the first opening and therefore also exert an anti-tampering action on the internal contents of the container.

The above-mentioned closed hinge arrangement between the cap or protective cover and the mouthpiece of the container limits the access space to the mouth of the container to a minimum, should anyone need or wish to drink. A small hinge arrangement is generally provided, in fact, between the cover and the tamper-proof ring, simply with an extension of material or a continuity of material between the cover and the ring.

Furthermore, this hinge arrangement creates a return elasticity between the cover and the ring, which greatly hinders access by a user who wishes to drink. The cover can even come into contact with the user's mouth or chin or face in general, when forced from its natural conformation. All of this creates a significant obstacle to the use of a container provided with this type of cap.

U.S. Pat. No. 6,474,491 B1 relates to a cap according to the prior art.

SUMMARY OF THE INVENTION

The general objective of the present invention is to provide a compact cap and a cap and container assembly with an opening block of the protective cover or cap, once opened, which overcomes the drawbacks of the prior art.

A further objective of the present invention is to provide a cap for a container capable of solving the above-mentioned drawbacks of the prior art in an extremely simple, economical and particularly functional way.

Another objective of the present invention is to provide a cap for a container, which enables its opening and provides for easy access to the mouthpiece of the container, and with which the cover is kept stably open.

Yet another objective of the present invention is to provide a cap for a container which can be produced by molding plastic material.

The above objectives are achieved by a cap for a container as described hereinafter.

BRIEF DESCRIPTION OF THE DRAWINGS

The structural and functional characteristics of the present invention and its advantages with respect to the known art will become even more evident from the following description, referring to the attached schematic drawings, which show an embodiment example of the invention.

In the drawings.

DETAILED DESCRIPTION OF EMBODIMENTS OF THE INVENTION

Figure 1:
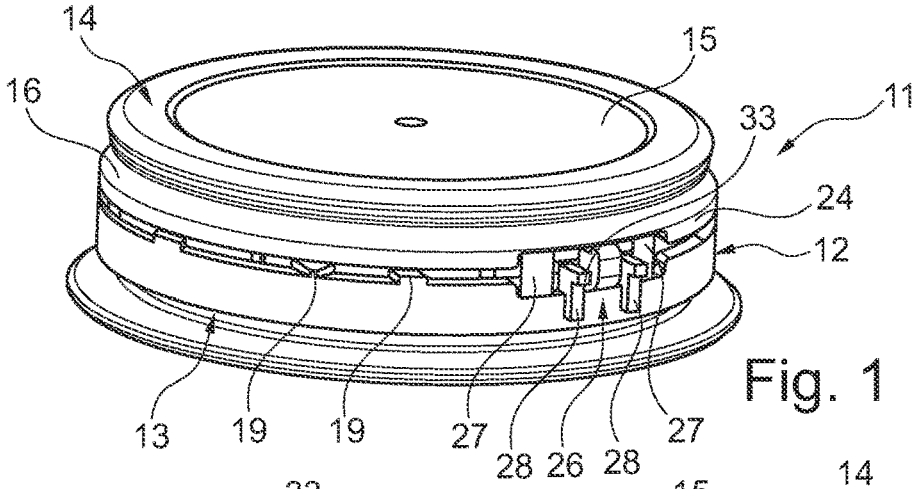
FIG. 1 is a perspective view from above of a compact cap and a cap and container assembly according to the present invention in a closed position.

The figures, which are exemplary and non-limiting, show an embodiment of a compact cap and a cap and container assembly with an opening block produced according to the present invention.

Indications such as "vertical" and "horizontal", "upper" and "lower" (in the absence of other indications) should be read with reference to the assembly (or operating) conditions and as referring to the normal terminology used in current language, wherein "vertical" indicates a direction substantially parallel to that of the force of gravity vector "g" and a horizontal direction indicates a direction perpendicular to the same.

This type of cap, indicated as a whole with 11, essentially comprises a base ring 12 for preventing its separation from a mouthpiece 13 of a container, and a cap or protective cover 14 for opening and closing the mouthpiece 13 of the container.

This type of cap 11 can be produced in a single piece by plastic molding.

The cap 14, essentially having the form of an inverted cup, provides a flat upper closing wall 15 and a shaped side wall 16, of the cylindrical type. The side wall 16 defines, near the upper wall 15, an annular area 17 protruding inwardly for engaging with an upper end edge 18 of the mouth 13 of the container, which protrudes outwardly.

It can also be noted that a collar or annular element 31 extends from the flat upper wall 15 inside the cover 14 towards the inside of the cap, said collar or annular element having a smaller diameter than the cover, coaxial to the same and configured to engage in an internal wall 32 of the mouthpiece 13 of the container. This arrangement favors and forms an effective seal for the liquid contained in the container.

A series of frangible bridges 19 connects a lower edge 20 of the cover 14 with an upper edge 21 of the base ring 12. Said base ring 12, having a substantially cylindrical shape, includes an internal rib 22 projecting inwardly for engagement beneath a perimetric rib 25 projecting outwardly from a side surface 23 of the mouthpiece 13 of the container.

The cap 11, in a slot or annular notch 24 that separates the cover 14 and the base ring 12, partly occupied by the frangible bridges 19, provides for a hinge arrangement 26, which causes the parts to be integral with each other.

This hinge arrangement 26 comprises a pair of flat spaced foldable strips or bridges 27 which connect the cover 14 and the base ring 12 and a pair of columns 28 interposed between the two strips 27. According to the present invention, an extension 29 enlarged outwardly is positioned right in the center, which is an integral part of an annular collar 30 formed at the lower end of the shaped side wall 16 of the cover 14.

Each column 28 provides, in the upper part, an appendage 33 protruding outwardly in a radial direction of the cap that is positioned and engaged, with the cover in an open position, with the lower edge of the cover 14.

These appendages 33 of the columns 28 are pushed into this engagement position when the extension 29, entering into engagement with the mouthpiece 13 when the cover 14 is rotated from a closed position to an open position, causes their stable positioning over the lower edge 20 of the cover 14 and consequently a stable positioning of the cover in an open position.

Thanks to the presence of this extension 29, the cover 14 can therefore remain stably rotated in an open position (FIGS. 9 and 11-13) specifically due to the engagement of the appendages 33 above the lower edge 20 of the cover 14.

The particular shaping of the extension 29 is such as to create a cam effect which, when the cover 14 is rotated for opening, increases its engagement with a portion of the mouthpiece 13, collaborating in this stable open positioning of the cover.

It can thus be understood how a cap according to the present invention solves the problems associated with the cited known art.

It can also be understood that the presence of the extension 29 favors the stable positioning of the snap-blocking appendages of the cover in an open position.

Figure 2:
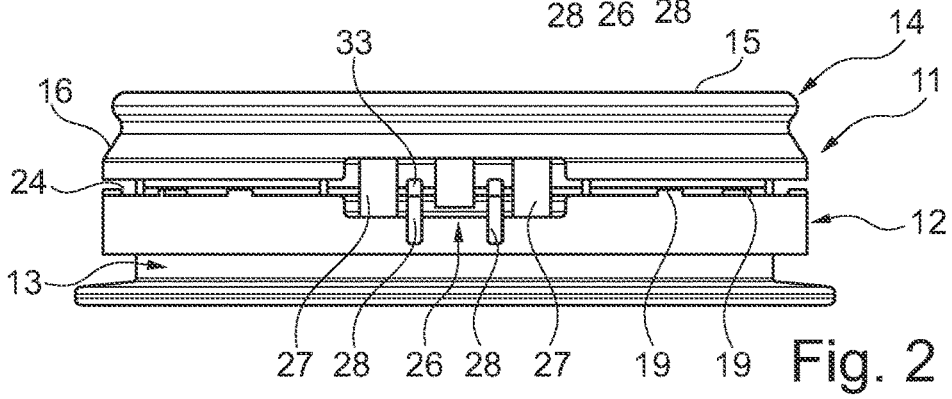
FIG. 2 is a raised side view from behind of the cap shown in FIG. 1.
Figure 3:
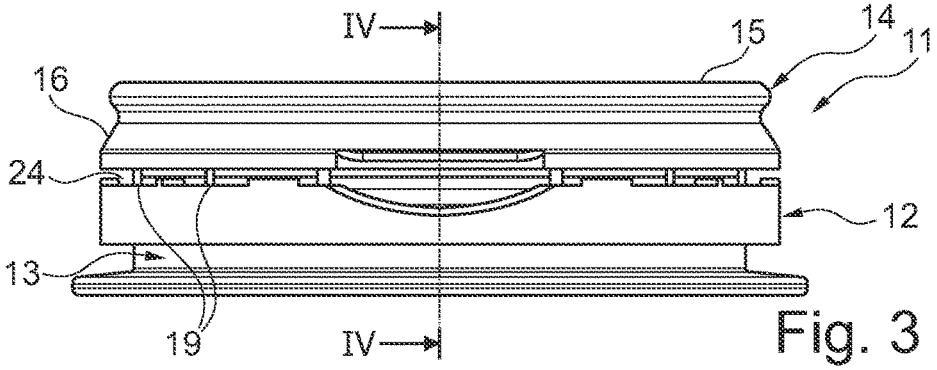
FIG. 3 is a raised front view of the cap of FIG. 1.
Figure 4:
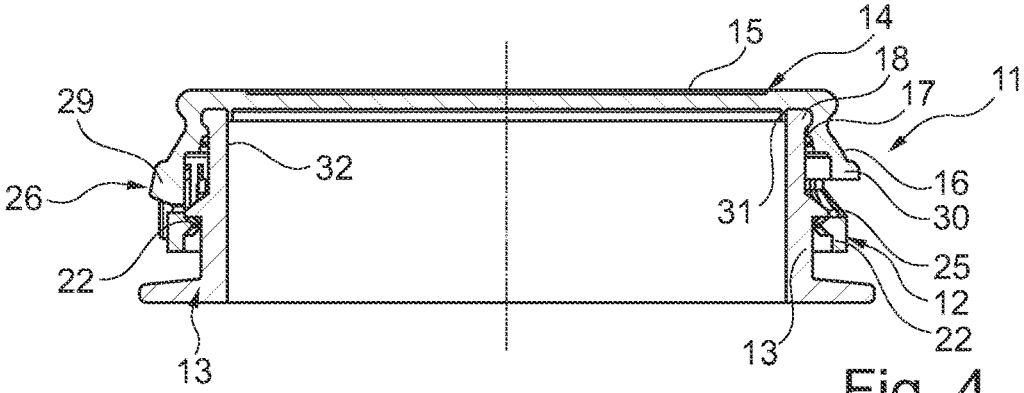
FIG. 4 is a sectional view along the line IV-IV of FIG. 3.
Figure 5:
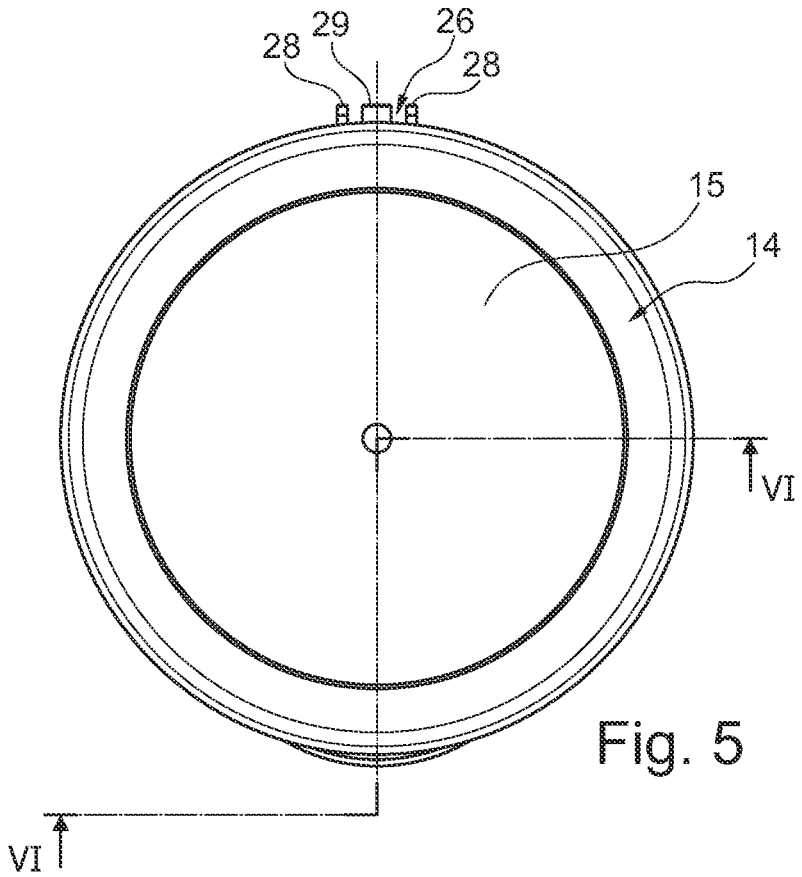
FIG. 5 is a plan view from above of the cap of FIG. 1.
Figure 6:
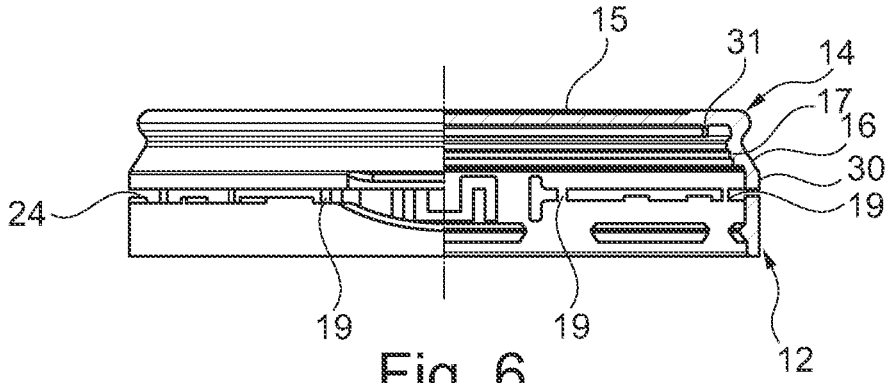
FIG. 6 is a sectional view along the line VI-VI of FIG. 5.
Figure 7:
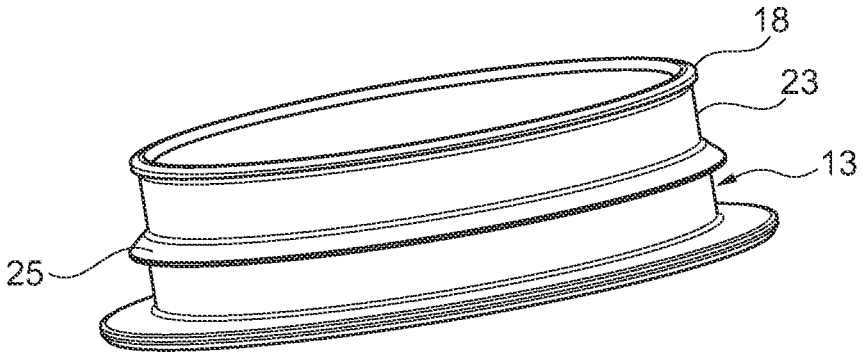
FIG. 7 is a perspective view from above of the mouthpiece alone of a container for a cap and container assembly according to the present invention.
Figure 8:
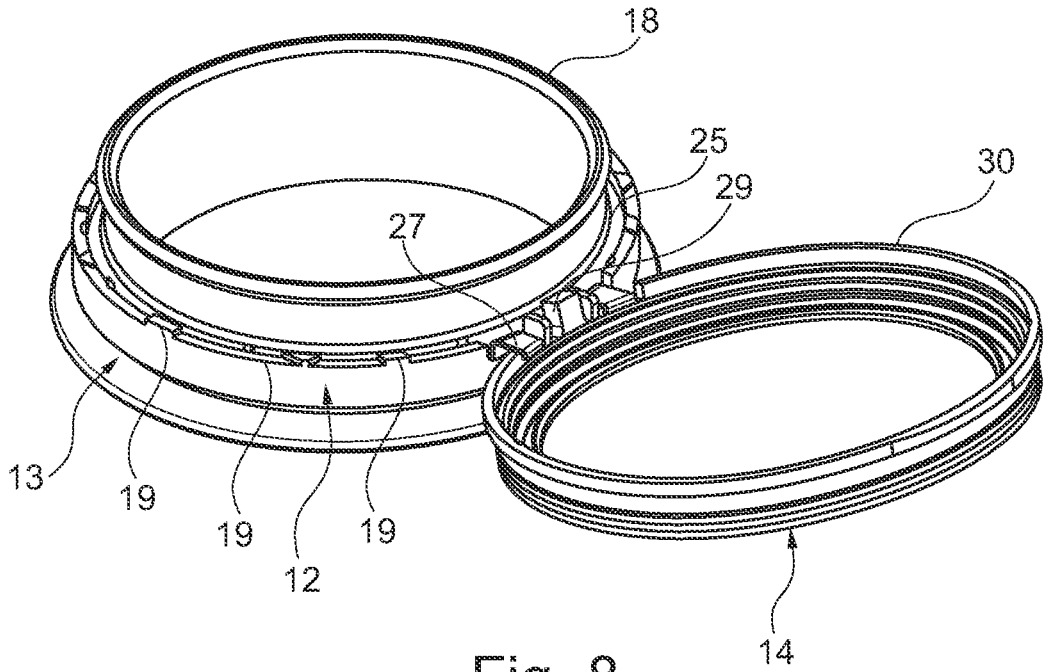
FIG. 8 is a perspective view from above of a cap and container assembly of FIG. 1 according to the present invention in an open position according to a first direction.
Figure 9:
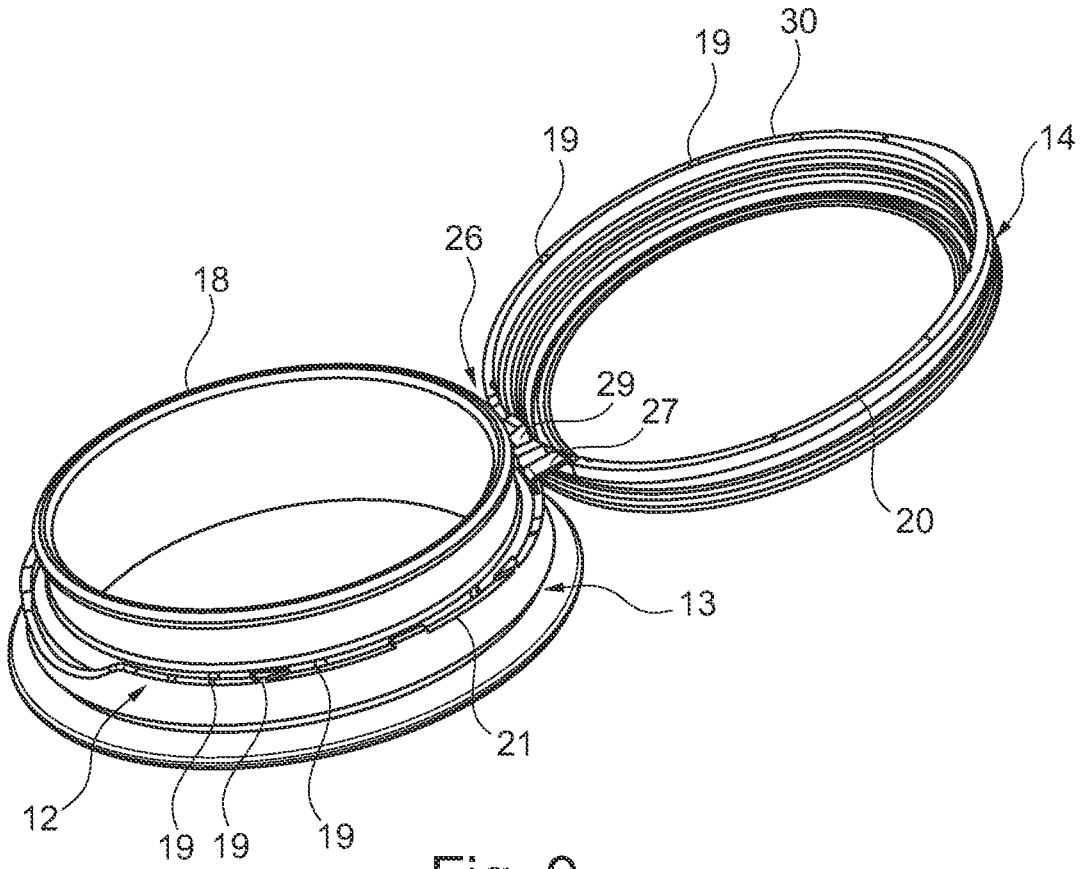
FIG. 9 is a perspective view from above of a cap and container assembly of FIG. 1 according to the present invention in an open position according to a second direction.
Figure 10:
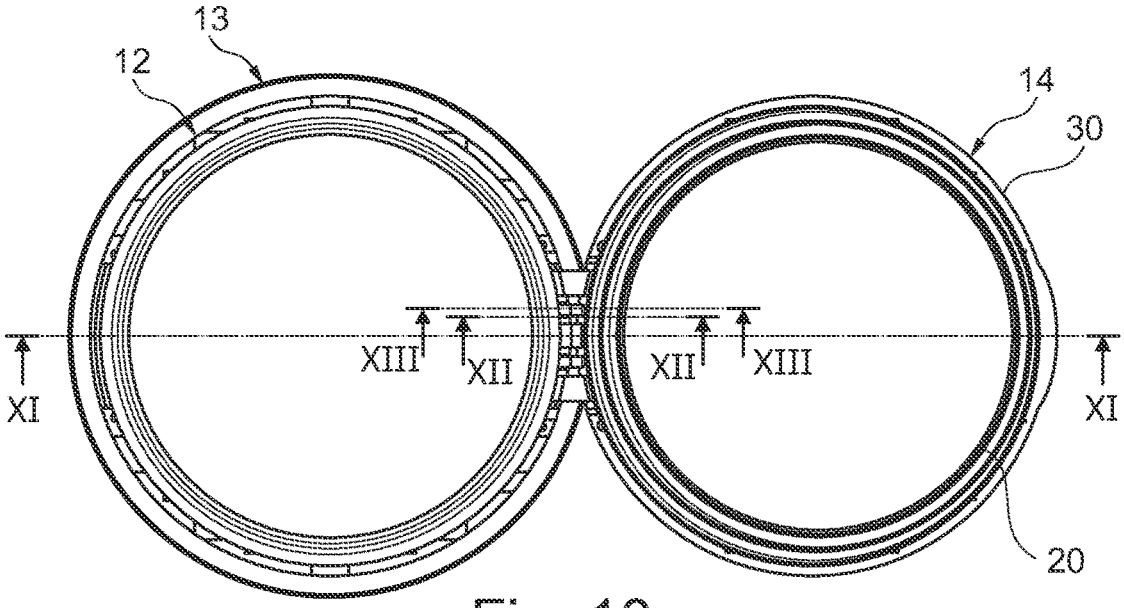
FIG. 10 is a plan view from above of the cap and container assembly of the present invention when open, the cap is rotated and opened.
Figure 11:
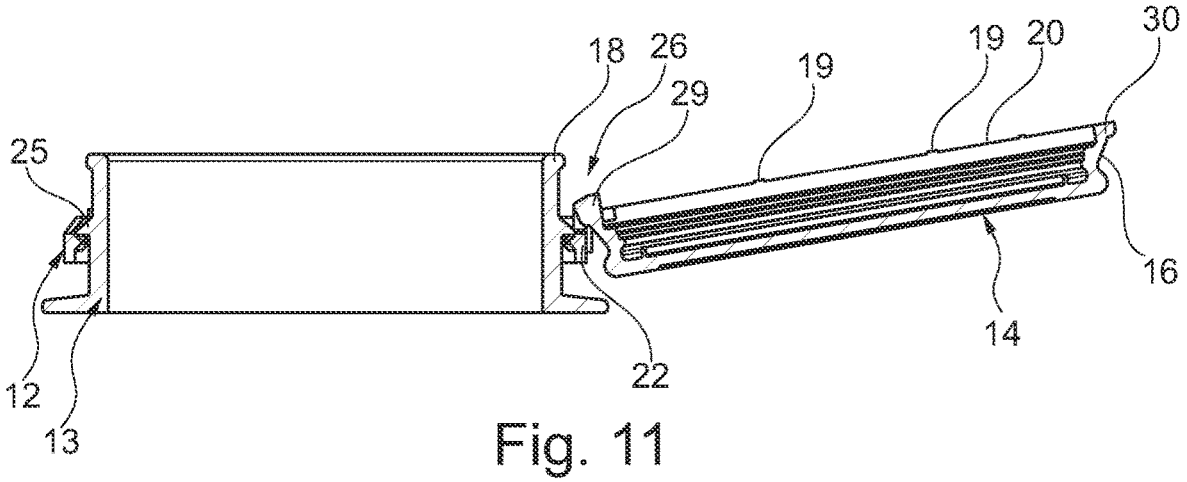
FIG. 11 is a raised sectional view along the line XI-XI of FIG. 10.
Figure 12:
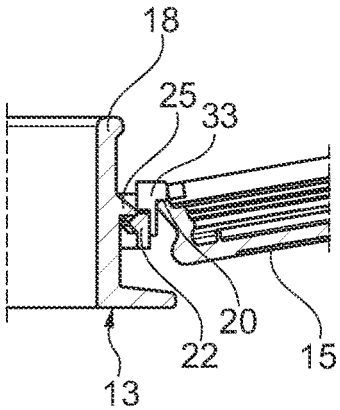
FIG. 12 is an enlarged sectional view of a detail taken along the line XII-XII of FIG. 10.
Figure 13:
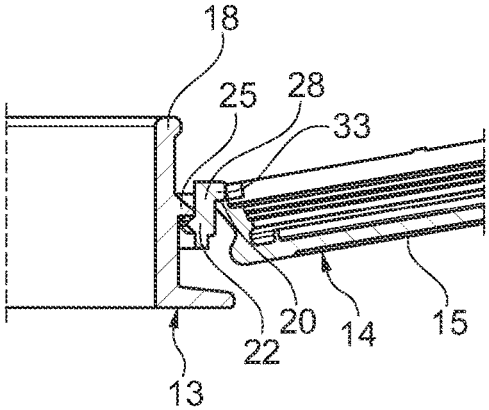
FIG. 13 is an enlarged sectional view of a further detail taken along the line XIII-XIII of FIG. 10.

FIGS. 8 and 9 show how the hinge arrangement 26 allows the cover 14 to be rotated by 180° or even more with respect to the closed position (FIGS. 1 to 3). This rotation is enabled once the cover 14 has been completely disengaged from the snap-engagement with the base ring 12 integral with the mouthpiece 13 of the bottle.

In this way, a stable opening position is created so that the cover 14 does not disturb a user who wishes to have access to the contents of the container, for example by bringing the mouthpiece 13 of the container or bottle to his mouth.

In the closed position, however, a sealed and safe position is created between the parts, which serves to reveal, as in all caps of this type, that the contents of the container are those filled by the original packager of the same.

It has thus been seen and understood how a compact cap and a cap and container assembly with an opening block, once opened, according to the present invention, while allowing its ample opening, also allows easy access to the mouthpiece of the container on which it is positioned.

Furthermore, the cap has an extremely small encumbrance which makes it suitable for specific applications where spaces are limited.

In addition, the constraint between the base or tamper-proof ring and the cover creates a cap in which, once the cover has been removed from the mouthpiece of the container, the cover is not separated from the attachment ring to the container.

It should also be considered that this type of cap is extremely simple and convenient to produce as it can be made by molding plastic in a single piece.

It should also be noted that a cap thus produced, for example in containers of fresh milk or non-carbonated drinks, reduces its weight, i.e., that of the container or mouthpiece. The product therefore uses smaller quantities of plastic and has a lighter weight, without any dispersion in the environment as the cap remains attached to the container or bottle.

Figure 14:
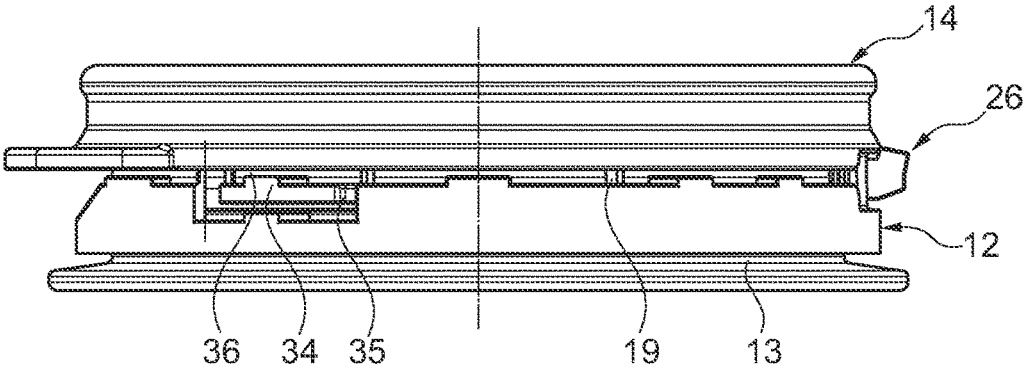
FIG. 14 is a raised side view of a further embodiment of a cap according to the invention.
Figure 15:
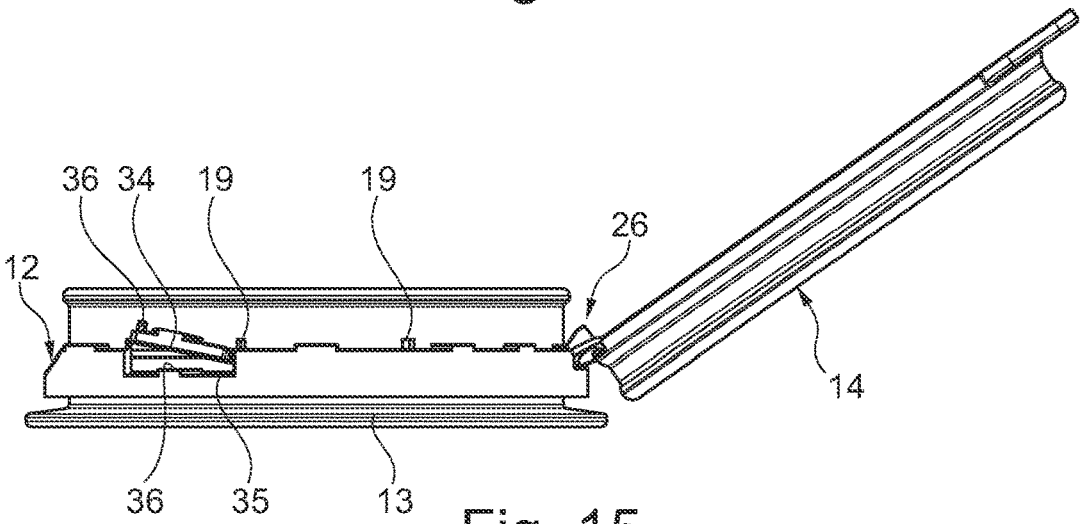
FIG. 15 is a view of the cap of FIG. 14 once opened with evidence of first opening.
Figure 16:
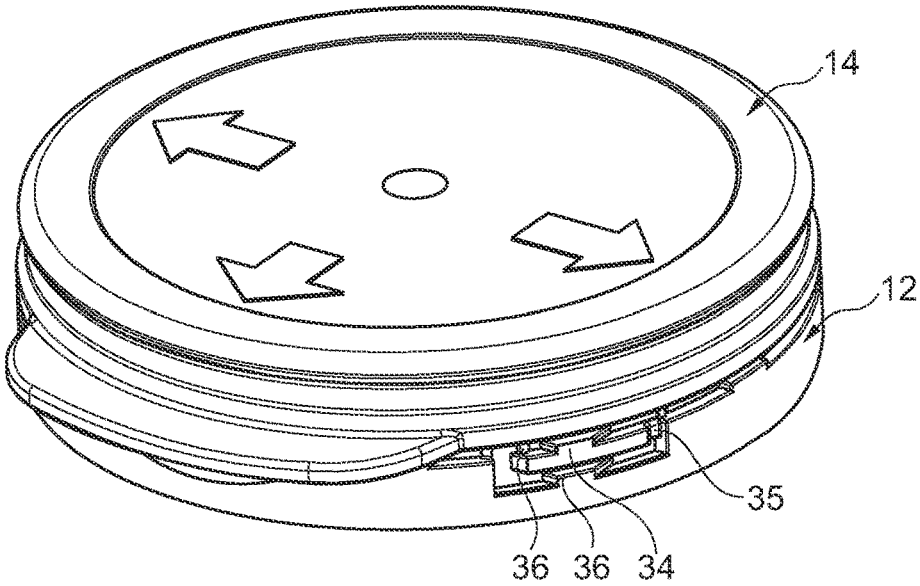
FIG. 16 is a perspective view from above of the cap of FIG. 1 not yet open.

FIGS. 14 to 16 show a second embodiment of a cap according to the invention in which identical elements are indicated with the same reference numbers.

Also in this second example, a cap 11 essentially comprises a base ring 12, for preventing its separation from a mouthpiece 13 of a container, and a cap or protective cover 14 for opening and closing the mouthpiece 13 of the container. The cap 11 can be produced in a single piece by the molding of plastic material.

Furthermore, as already seen, a series of frangible bridges 19 is provided which connects the lower edge 20 of the cover 14 with the upper edge 21 of the base ring 12.

In addition to all the features indicated above, it should be noted that in the cap, the protective cover 14 and the base ring 12 are further connected to each other by a security rod 34.

Said security rod 34 is stably connected and pivoted at a lower end 35 to the base ring 12. Further frangible bridges 36 connect this security rod 34 to both the base ring 12 and to the protective cap or cover 14, and they break when opened for the first time, guaranteeing the integrity and originality of the cap.

This is a further new and original arrangement in the cap that irreversibly reveals whether it has been subjected to a first opening. In this case, the security rod 34 remains as shown in FIG. 15, once the protective cap or cover 14 has been raised and rotated with respect to the base ring 12.

The objective mentioned in the preamble of the description has thus been achieved.

The protection scope of the present invention is defined by the enclosed claims.

The invention claimed is:

1. A compact cap with an opening block, after opening, adapted for a container comprising a substantially cylindrical mouthpiece having an upper end annular edge protruding radially toward an exterior of the mouthpiece, the cap comprising:

a base ring configured to prevent separation of the cap from a mouthpiece of a container;

a protective cap or cover configured to open and close the mouthpiece of the container;

a hinge arrangement that makes the base ring and the cover integral with each other and configured to be produced in a single piece by molding a plastic material; and a series of frangible bridges, which connect a lower edge of the cover with an upper edge of the base ring when the cover is arranged for closing on the ring base and on the mouthpiece, wherein the hinge arrangement comprises a plurality of spaced strips or bridges, which connect the cover and the base ring, and an extension enlarged radially toward an exterior of the compact cap, the extension forming an integral part of an annular collar obtained at a lower end of the cover facing the base ring, the extension becoming engaged with the mouthpiece when the cover is rotated from a closed position to an open position to create a stable position of the cover when open, and wherein the hinge arrangement further comprises a plurality of columns, interposed between the plurality of strips or bridges, which have upper appendages protruding radially toward an exterior of the compact cap, the appendages, when the cover is in the open position, being positioned above and engaging the lower edge of the cover.

2. The compact cap according to claim 1, wherein the extension is shaped and is configured to create a cam effect, which, when the cover is rotated for opening, increases an engagement of the cover with a portion of the mouthpiece.

3. The compact cap according to claim 1, wherein the plurality of spaced strips or bridges, which connect the cover and the base ring, are foldable.

4. The compact cap according to claim 1, wherein the cover is shaped as an inverted cup, and comprises a flat upper closing wall and a shaped side wall, of a cylindrical type, and wherein the shaped side wall comprises, adjacently to the upper wall, an annular area protruding inwardly radially, which is configured to engage the upper end edge of the mouthpiece of the container, the upper end edge of the mouthpiece protruding outwardly radially.

5. The compact cap according to claim 4, wherein a collar or annular element extends from the upper wall inside the cover toward an inside of the cap, the collar or annular element having a smaller diameter than the cover, being coaxial to the cover, and being configured to engage an internal wall of the mouthpiece of the container.

6. The compact cap according to claim 1, wherein the cover and the base ring are further connected to each other by a security rod, which is stably constrained and pivoted at a lower end to the base ring and has additional frangible bridges, which connect the security rod to both the base ring and the cover.

7. A cap and container assembly with an opening block of a cover of the assembly, after opening, the container comprising a substantially cylindrical mouthpiece having an upper end edge protruding radially toward an exterior of the mouthpiece, the cap comprising:

a base ring configured to prevent separation of the cap from the mouthpiece of the container;

a protective cap or cover configured to open and close the mouthpiece of the container;

a hinge arrangement that makes the base ring and the cover integral with each other and configured to be produced in a single piece by molding a plastic material; and a series of frangible bridges, which connect a lower edge of the cover with an upper edge of the base ring when the cover is arranged for closing on the ring base and on the mouthpiece, wherein the hinge arrangement comprises a plurality of spaced strips or bridges, which connect the cover and the base ring, and an extension enlarged radially toward an exterior of the cap, the extension forming an integral part of an annular collar obtained at a lower end of the cover facing the base ring, the extension becoming engaged with the mouthpiece when the cover is rotated from a closed position to an open position to create a stable position of the cover when open, and wherein the hinge arrangement further comprises a plurality of columns, interposed between the plurality of strips or bridges, which have upper appendages protruding radially toward an exterior of the cap, the appendages, when the cover is in the open position, being positioned above and engaging the lower edge of the cover.

8. The cap and container assembly according to claim 7, wherein the extension is shaped and is configured to create a cam effect, which, when the cover is rotated for opening, increases an engagement of the cover with a portion of the mouthpiece.

9. The cap and container assembly according to claim 7, wherein the plurality of spaced strips or bridges, which connect the cover and the base ring, are foldable.

10. The cap and container assembly according to claim 7, wherein the cover and the base ring are further connected to each other by a security rod, which is stably constrained and pivoted at a lower end to the base ring and has additional frangible bridges, which connect the security rod to both the base ring and the cover.

* * * * *